US006870558B2

(12) United States Patent
Katsuma et al.

(10) Patent No.: US 6,870,558 B2
(45) Date of Patent: Mar. 22, 2005

(54) OPTICAL FIXING UNIT, ILLUMINANCE CORRECTING METHOD FOR THE SAME, AND THERMAL PRINTER

(75) Inventors: Nobuo Katsuma, Saitama (JP); Akihiko Machida, Saitama (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 42 days.

(21) Appl. No.: 10/350,133

(22) Filed: Jan. 24, 2003

(65) Prior Publication Data

US 2003/0142195 A1 Jul. 31, 2003

(30) Foreign Application Priority Data

Jan. 28, 2002 (JP) ..... 2002-019048
Jul. 17, 2002 (JP) ..... 2002-208675

(51) Int. Cl.[7] ..... B41J 2/315
(52) U.S. Cl. ..... 347/212
(58) Field of Search ..... 347/171, 177, 347/179, 210, 236, 246, 155, 156, 212; 345/589; 358/475; 399/49; 430/328, 336, 350, 352

(56) References Cited

U.S. PATENT DOCUMENTS 5,119,132 A * 6/1992 Butler ..... 399/49
5,229,870 A * 7/1993 Inoguchi ..... 358/475
5,986,682 A * 11/1999 Itou ..... 347/171
6,583,791 B2 * 6/2003 Berryman et al. ..... 345/589

FOREIGN PATENT DOCUMENTS

JP 2001171157 A * 6/2001 ..... B41J/2/32

* cited by examiner

*Primary Examiner*—Hai Pham
(74) *Attorney, Agent, or Firm*—Sughrue Mion, PLLC

(57) ABSTRACT

A yellow luminous-element array, which is an optical fixing unit, includes a large number of yellow LEDs emitting ultraviolet rays. The LEDs in each of lines extending in a feeding direction are connected in series. Integral illuminance of each line is adjusted by changing electrical energy to be supplied to the respective lines. The integral illuminance of each line extending in the feeding direction is measured to obtain illuminance distribution relative to a scanning direction when the yellow luminous-element array is examined at the time of manufacture thereof. The integral illuminance of each line is corrected so as to even the illuminance distribution.

29 Claims, 11 Drawing Sheets

| RESISTOR / ILLUMINATION RANK | | R1 (1000Ω) | R2 (6725Ω) | R3 (5850Ω) | R4 (5100Ω) | R5 (4440Ω) |
|---|---|---|---|---|---|---|
| A | 100~87(%) | O | X | X | X | X |
| B | 86~76(%) | O | O | X | X | X |
| C | 76~66(%) | O | O | O | X | X |
| D | 66~57(%) | O | O | O | O | X |
| E | 57~50(%) | O | O | O | O | O |

O : CONNECTION
X : NON-CONNECTION

OPTICAL FIXING UNIT, ILLUMINANCE CORRECTING METHOD FOR THE SAME, AND THERMAL PRINTER

BACKGROUND OF THE INVENTION

1. Field of the Invention

The present invention relates to an optical fixing unit including a luminous-element array, which is used as a light source to emit fixing rays toward a thermosensitive recording material and in which a large number of luminous elements are arranged in matrix. The present invention further relates to an illuminance correcting method for the optical fixing unit and relates to a thermal printer using the optical fixing unit.

2. Description of the Related Art

There are color thermal printers for obtaining a full-color print. This kind of the thermal printer uses a color thermosensitive recording paper in which at least three thermosensitive coloring layers coloring in different colors are stacked. Thermal sensitivity of the coloring layer is lower as a position thereof is lower. The first and second thermosensitive coloring layers, which are respectively the uppermost layer and the adjacent layer thereof, possess fixation properties caused by ultraviolet rays of specific wavelength ranges. In the color thermal printer, while the color thermosensitive recording paper is reciprocated in a feeding direction, a thermal head disposed in a scanning direction is pressed thereon to perform thermal recording for the respective coloring layers. After the thermal recording has been performed for each coloring layer, the ultraviolet rays are applied by using a fixing unit to fix the thermally-recorded coloring layer so that the upper coloring layer is prevented from coloring when the thermal recording is performed for the lower coloring layer.

As a light source of the fixing unit, is used a mercury fluorescent lamp having a tube shape. A section of the mercury fluorescent lamp is generally circle so that the ultraviolet rays are uniformly radiated around the mercury fluorescent lamp. Thus, a reflector is disposed near the mercury fluorescent lamp in order to reflect the ultraviolet rays, which are uselessly radiated, toward the color thermosensitive recording paper. The mercury fluorescent lamp to be used has a double length of a width of the thermal recording paper (relative to the scanning direction) in consideration of light-amount attenuation caused at both ends of the mercury fluorescent lamp. Thus, the mercury fluorescent lamp has a disadvantage regarding arrangement space so that it is difficult to downsize the printer.

When the fixing unit has a large size, a conveyance distance of the color thermosensitive recording paper becomes long and printing time increases. Since the mercury fluorescent lamp greatly depends on a temperature of a light amount, a control circuit is necessary for controlling the light amount in accordance with variations of the temperature. Further, since the light amount changes with the passage of time, periodic maintenance is required. As stated above, there are problems concerning the manufacture cost and the maintenance.

On account of the above, an optical fixing unit using a luminous-element array is proposed. The luminous-element array includes a large number of small luminous elements, which are arranged in a scanning direction and a feeding direction so as to form a matrix. The luminous element is a light emitting diode, for example.

However, the luminous-element array uses many luminous elements. Thus, there arises a problem in that illuminance of the respective luminous elements vary. Further, there arises another problem in that illuminance distribution becomes uneven in the scanning direction due to a mounting error of the luminous element.

In order to even out the illuminance distribution in the scanning direction, it is considered to repair all of the defect elements, which are not turned on, by exchanging and rewiring the element. However, the luminous element is small and wiring thereof is fine. Thus, there is a problem in that it takes a lot of labors for a repair operation.

SUMMARY OF THE INVENTION

In view of the foregoing, a primary object of the present invention is to easily correct illuminance dispersion of an optical fixing unit, which uses a luminous-element array, in a scanning direction.

A second object of the present invention is to obtain an appropriate amount of fixing rays even if illuminance of a luminous-element array is changed due to variations of temperature.

In order to achieve the above and other objects, an illuminance correcting method for the optical fixing unit according to the present invention examines illuminance distribution in a scanning direction. The optical fixing unit is used in a thermal printer thermally recording an image by heating a thermosensitive recording material, which is conveyed in a feeding direction, with a thermal head disposed in the scanning direction. The optical fixing unit comprises a luminous-element array, as a light source, in which a large number of luminous elements radiating ultraviolet rays are arranged in matrix relative to the scanning direction and the feeding direction. The fixing unit performs optical fixation with the ultraviolet rays radiated from the light source, conveying the thermal recording material on which an image has been thermally recorded. In the illuminance correcting method, integral illuminance of the luminous elements is obtained with respect to each of feeding-direction lines of the luminous-element array to examine the illuminance distribution in the scanning direction. The integral illuminance is corrected every line so as to even the illuminance distribution in the scanning direction.

In a preferred embodiment, the luminous elements of the feeding-direction line of the luminous-element array are connected in series, and the integral illuminance thereof is corrected by adjusting electrical energy to be supplied to the luminous elements of each line.

It is preferable to provide a measurement member and a control member. The measurement member measures illuminance of the luminous-element array. The control member compares a measured value of the measurement member with a desired value, which is set in advance, to control an amount of the rays to be received by the thermosensitive recording material.

When the luminous-element array is driven by a drive-pulse signal, the control member for controlling the amount of the rays corrects the illuminance of the luminous-element array by changing a duty ratio of the drive-pulse signal.

According to the present invention, illuminance dispersion of the optical fixing unit may be easily corrected in the scanning direction. Further, an appropriate amount of the fixing rays may be obtained even if the illuminance of the luminous-element array is changed due to variations of temperature.

BRIEF DESCRIPTION OF THE DRAWINGS

The above objects and advantages of the present invention will become apparent from the following detailed description of the preferred embodiments of the invention when read in conjunction with the accompanying drawings, in which.

DETAILED DESCRIPTION OF THE PREFERRED EMBODIMENT(S)

Figure 1:
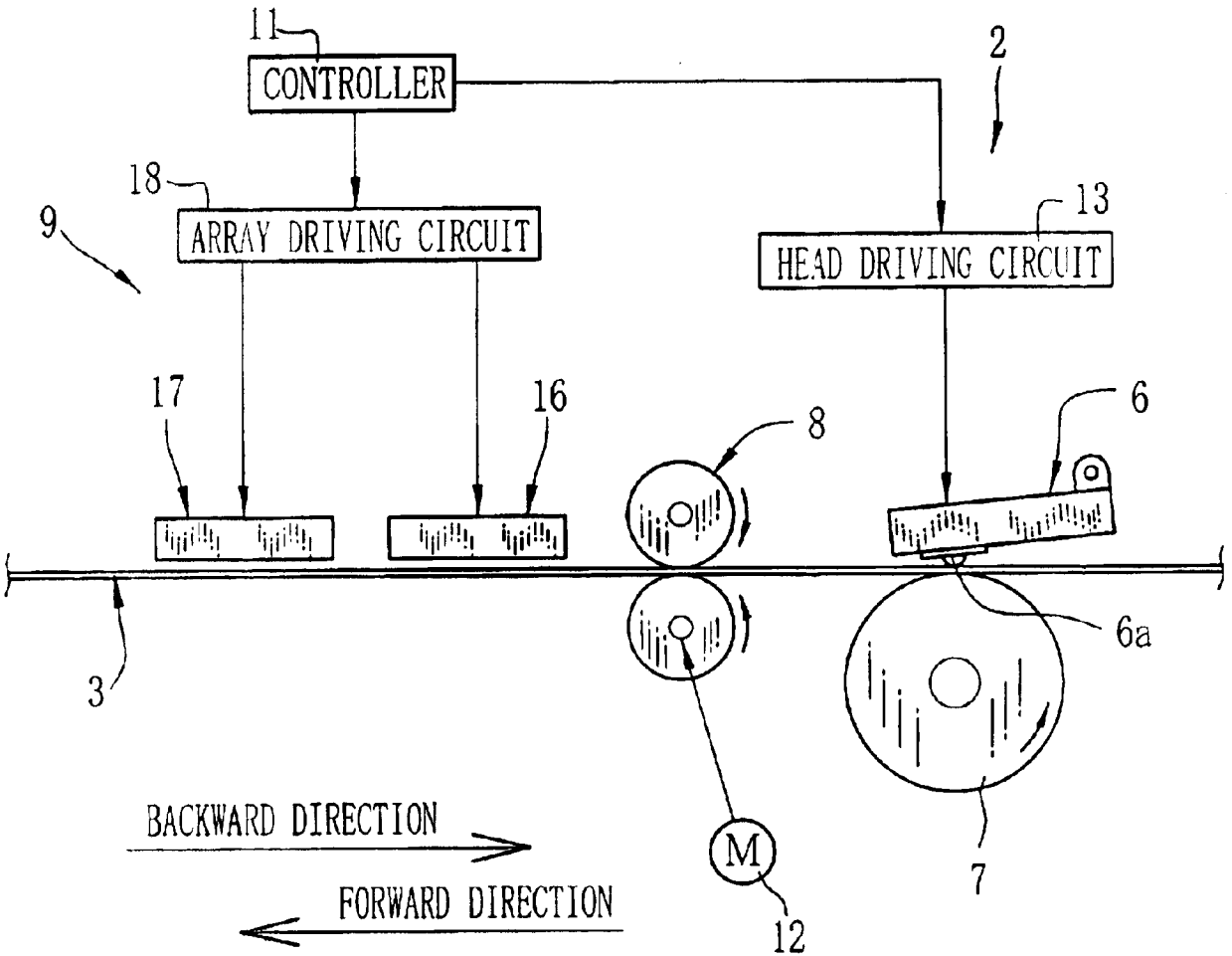
FIG. 1 is a schematic illustration showing a structure of a color thermal printer.

A color thermal printer 2 shown in FIG. 1 reciprocates a color thermosensitive recording paper 3 in a forward direction and a backward direction to thermally record a full-color image and optically fix the color thermosensitive recording paper 3 on which the image is thermally recorded. The color thermal printer 2 comprises a thermal head 6, a platen roller 7, a conveyor roller pair 8, an optical fixing unit 9, and a controller 11. The thermal head 6 heats and colors each of thermosensitive coloring layers of the recording paper 3. The platen roller 7 confronts the thermal head 6 to support the recording paper 3. The conveyor roller pair 8 conveys the recording paper 3. The controller 11 controls each section of the printer.

The color thermosensitive recording paper 3 comprises a cyan thermosensitive coloring layer, a magenta thermosensitive coloring layer, and a yellow thermosensitive coloring layer, which are stacked in order on a support as well known. The yellow thermosensitive coloring layer is the uppermost layer and has the highest thermal sensitivity so as to color in yellow with small thermal energy. The cyan thermosensitive coloring layer is the lowermost layer and has the lowest thermal sensitivity so as to color in cyan with great thermal energy. The yellow thermosensitive coloring layer, which is the first thermosensitive coloring layer, loses an ability to color when near ultraviolet rays of 420 nm is applied thereto. The magenta thermosensitive coloring layer, which is the second thermosensitive coloring layer, colors in magenta with thermal energy intermediately ranked between those of the yellow and cyan thermosensitive coloring layers. The magenta thermosensitive coloring layer loses an ability to color when ultraviolet rays of 365 nm is applied thereto. The color thermosensitive recording paper 3 may have a four-layer structure by providing a black thermosensitive coloring layer, for example.

The conveyor roller pair 8 nips the fed recording paper 3 to convey it in a feeding direction. During this conveyance, the color thermosensitive recording paper 3 passes the thermal head 6 and the optical fixing unit 9 to execute a printing process. After the printing process, the recording paper 3 is cut into a predetermined size by a cutter, which is not shown, and is discharged to the outside of the color thermal printer 2. Incidentally, the conveyance roller pair 8 is driven by a drive motor 12.

As well known, the thermal head 6 includes a large number of heating elements aligned in a scanning direction. Each of the heating elements generates thermal energy in accordance with pixel density so as to thermally record an image of each color of yellow, magenta and cyan on the respective thermosensitive coloring layers. The thermal head 6 is driven by a head driving circuit 13.

The optical fixing unit 9 comprises a yellow luminous-element array 16, a magenta luminous-element array 17, and an array driving circuit 18 for driving the respective arrays. The yellow and magenta luminous-element arrays 16 and 17 are optical fixers respectively used for yellow and magenta. The arrays 16 and 17 are disposed at a downstream side of the thermal head 6 in a forward direction, and luminescent faces thereof confront a recording surface of the color thermosensitive recording paper 3. The yellow luminous-element array 16 is a light source for fixing the yellow thermosensitive coloring layer by emitting the near ultraviolet rays whose luminescent peak is 420 nm. The magenta luminous-element array 17 is a light source for fixing the magenta thermosensitive coloring layer by emitting ultraviolet rays whose luminescent peak is 365 nm.

Figures 2A, 2B:
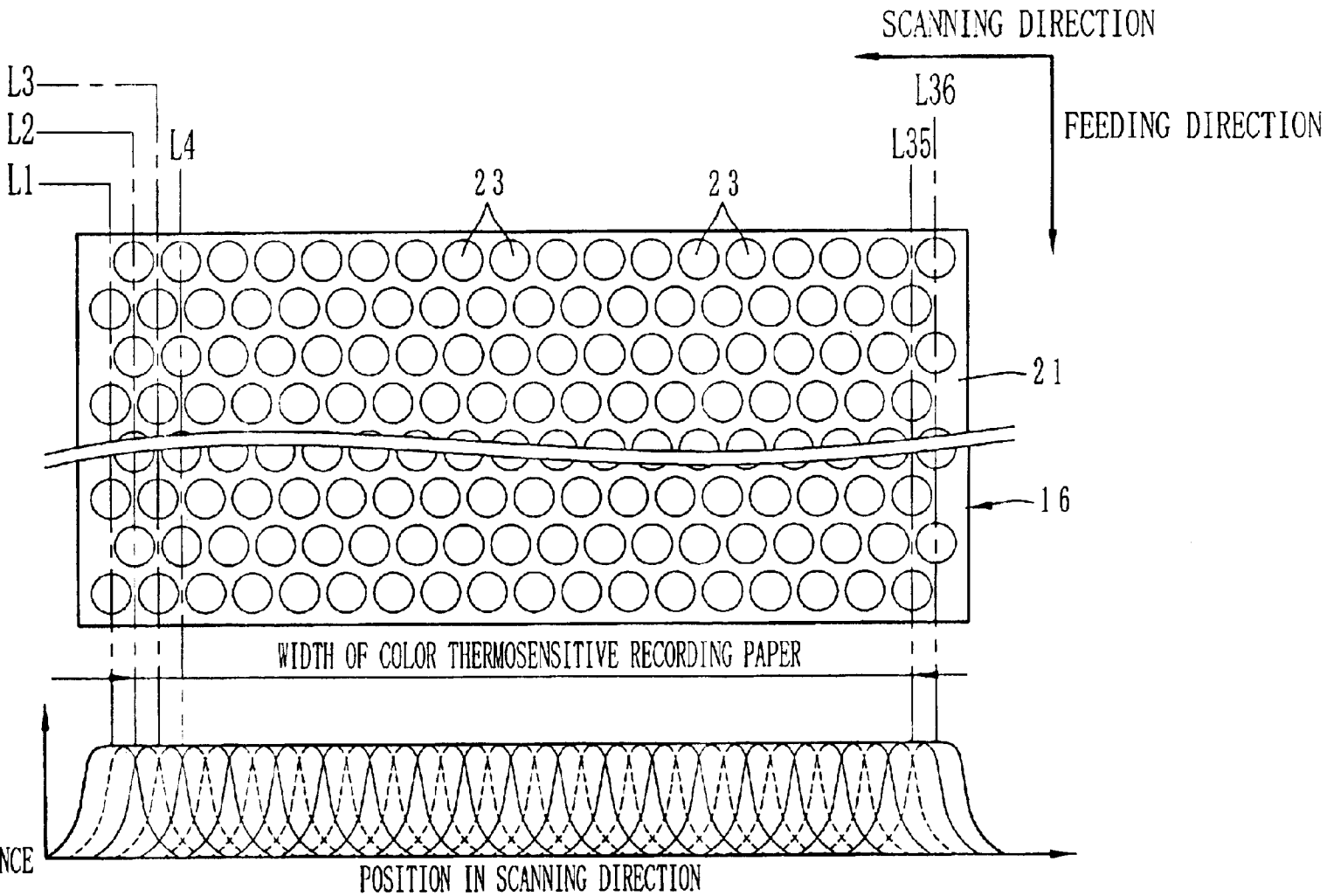
FIGS. 2A and 2B are explanatory illustrations showing LED-arrangement of a luminous-element array and illuminance distribution thereof in a scanning direction.

FIG. 2A shows the yellow luminous-element array 16 viewed from the bottom thereof. As shown in FIG. 2A, the yellow luminous-element array 16 includes a base 21 on which a large number of yellow light-emitting diodes (hereinafter, simply called as Y-LED) 23 are arranged in a matrix-like form in both directions of the scanning direction and the feeding direction. The Y-LED 23 emits the near ultraviolet rays whose luminescent peak is 420 nm.

The Y-LEDs 23 are arranged in a zigzag form. Illuminance of the Y-LED 23 is high at a central position thereof and is low at a peripheral portion thereof. Thus, the illuminance falls at an intermediate position of the adjacent Y-LEDs 23. In view of this, the Y-LEDs 23 are arranged in the zigzag form so that portions (peripheral portions) of the Y-LEDs 23 having low illuminance are adapted to compensate each other.

FIG. 2B is a graph showing distribution of integral illuminance relative to the scanning direction. The integral illuminance is a total value obtained from the illuminance of the plural Y-LEDs 23 belonging to each of lines L1 to L36 extending in the feeding direction. In the graph, a solid line represents the integral illuminance of the odd line, and a broken line represents the integral illuminance of the even line. Since the luminous-element array comprises a large number of LEDs, the integral illuminance of the respective lines are varied if a defective element is caused by bad lighting of the LED, bad wiring and so forth. Consequently, unevenness of fixation occurs. In the present embodiment, the integral illuminance of the respective lines are corrected, so as not to vary, in an examination process at the time of manufacturing the luminous-element array, such as described later. Thus, the distribution of the illuminance is adapted to become a even state such as shown in FIG. 2B. In virtue of this, the fixation unevenness caused by the defective element is prevented.

Figure 4:
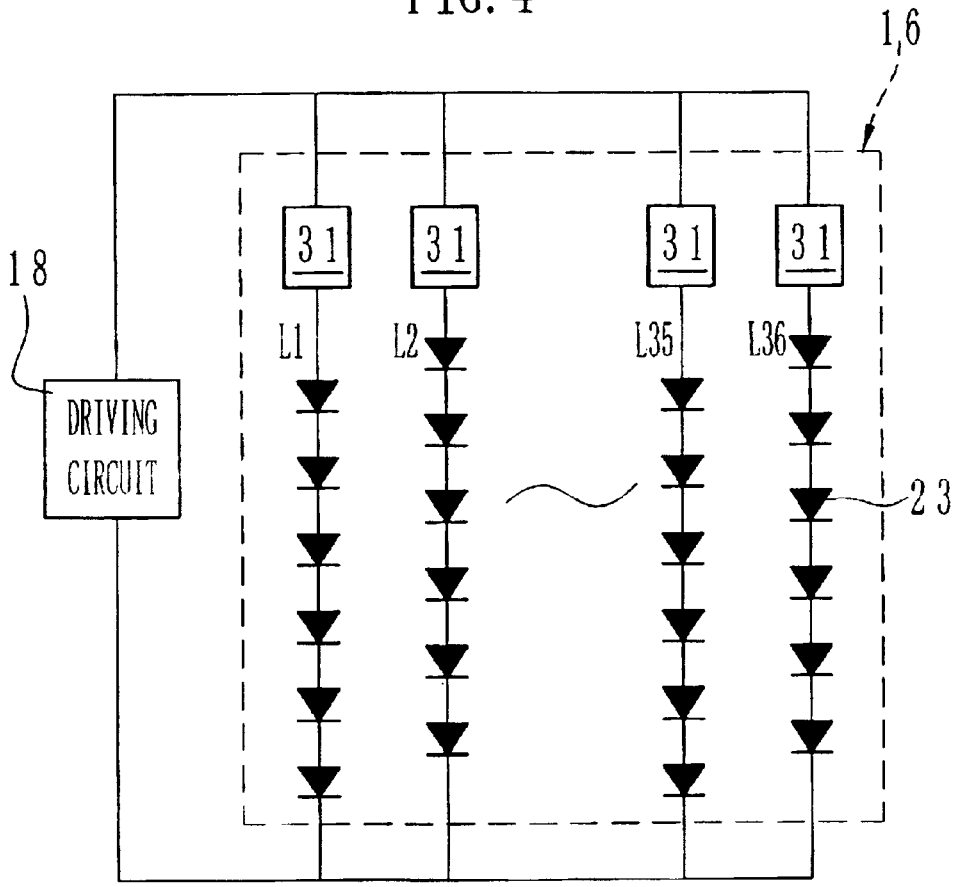
FIG. 4 is an explanatory illustration showing a manner for connecting LEDs.

As shown in FIG. 4, the Y-LEDs 23 of the respective lines L1 to L36 extending in the feeding direction are connected in series. A current stabilizing circuit 31 is connected to each of the lines L1 to L36 to stabilize an electric current flowing in the Y-LEDs 23 of the respective lines L1 to L36.

Figures 5A, 5B:
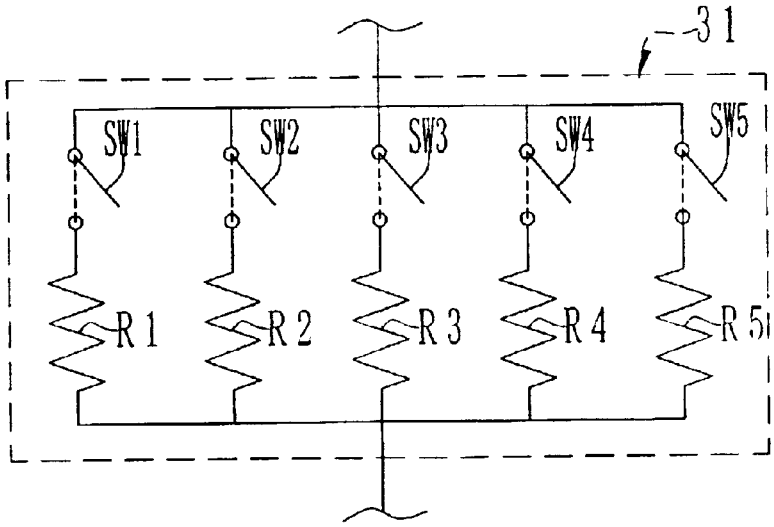
FIGS. 5A and 5B are explanatory illustrations showing a current stabilizing circuit.

As shown in FIG. 5A, the current stabilizing circuit 31 includes a plurality of resistors R1 to R5 connected in parallel. The resistors R1 to R5 are connected to switches SW1 to SW5 respectively in series. A combined-resistance value is varied by turning on and off the respective switches SW1 to SW5 to adjust electrical energy to be supplied to the Y-LEDs 23 of the respective lines L1 to L36. In virtue of this adjustment, the integral illuminance of each line is corrected.

In other words, the resistors R1 to R5 are connected in parallel so that the combined-resistance value R becomes smaller as a number of the connected resistors increases. In contrast, the combined-resistance value R becomes greater as the number of the connected resistors decreases. When a voltage is constant, a value of the current to be supplied to the line is changed by varying the combined-resistance value.

With respect to the line having low integral illuminance, the combined-resistance value R is lowered in the examination process of the manufacturing stage by increasing a number of the resistors to be connected. In doing so, the current value increases so that the integral illuminance also increases. In contrast, with respect to the line having higher integral illuminance, the combined-resistance value R is increased by reducing the number of the resistors to be connected. In doing so, the current value lowers so that the integral illuminance also lowers. In this way, the electrical energy to be supplied is adjusted relative to each of the lines L1 to L36. Thus, the illuminance distribution in the scanning direction is corrected so as to become an even state.

For instance, as shown in FIG. 5B, the resistance values of the resistors R1 through R5 are respectively set to 1000Ω, 6725Ω, 5850Ω, 5100Ω, and 4440Ω. Further, ranks of the integral illuminance are predetermined as five steps of A-rank to E-rank, and the resistors to be connected is determined in accordance with the respective ranks. A parentage (%) of each rank is based on the reference integral illuminance, which is set to 100% when there is no defective element.

Figure 3:
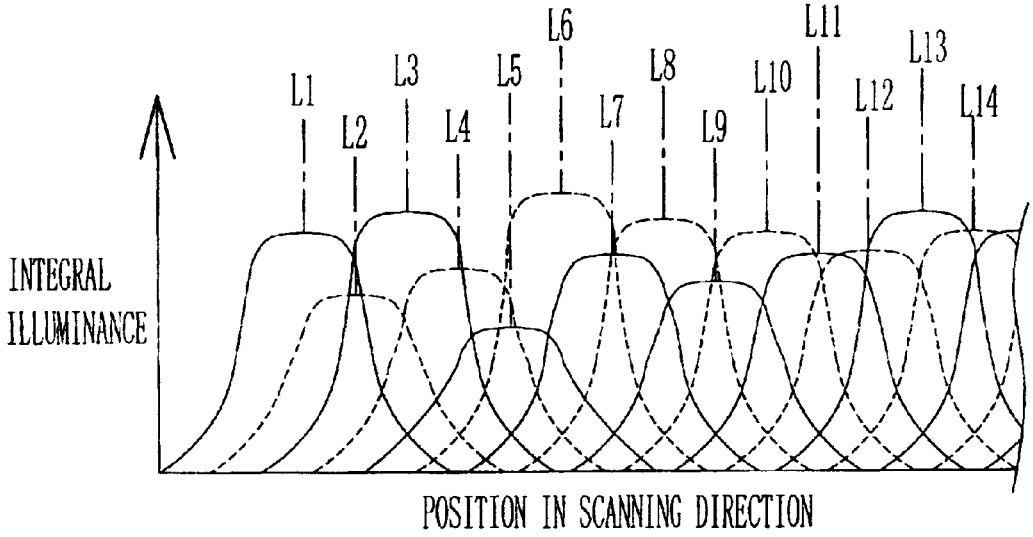
FIG. 3 is an explanatory illustration showing the illuminance distribution of the luminous-element array in the scanning direction, which is obtained at the time of manufacture.

In the manufacturing stage, such as shown in FIG. 3, there are defective elements caused by the defective LED, bad wiring and so forth. Thus, the integral illuminance of the respective lines L1 to L36 vary. The measured integral illuminance of the respective lines L1 to L36 are allocated to the respective ranks for selecting the resistor to be connected. In the case of the A-rank, only the resistor R1 is connected. Consequently, only the switch SW1 is turned on and the other switches SW2 to SW5 are turned off. In the case of the B-rank, the resistor R1 and the resistor R2 are connected. In this case, the switches SW1 and SW2 are turned on and the other switches are turned off. In the cases of the C-rank to E-rank, similar adjustment are carried out.

Incidentally, the way of connecting the resistors is described in the embodiment using the switches SW1 to SW5. However, the switches SW1 to SW5 may be removed. For example, all the resistors R1 to R5 may be connected at the time of manufacture (in an initial condition). In this case, connection of the non-selected resistor is cut with a laser cutter and so forth. Alternatively, all the resistors may be set to a non-connection state in the initial condition. In this case, the selected resistor is connected by a solder at the time of adjustment.

In this way, the illuminance is corrected every line by the adjusting member, which adjusts the integral illuminance of the respective lines extending in the feeding direction. Thus, exchange of the LED and rewiring are unnecessary relative to all the defective elements failing to emit the rays so that the illuminance is easily corrected.

Figure 6:
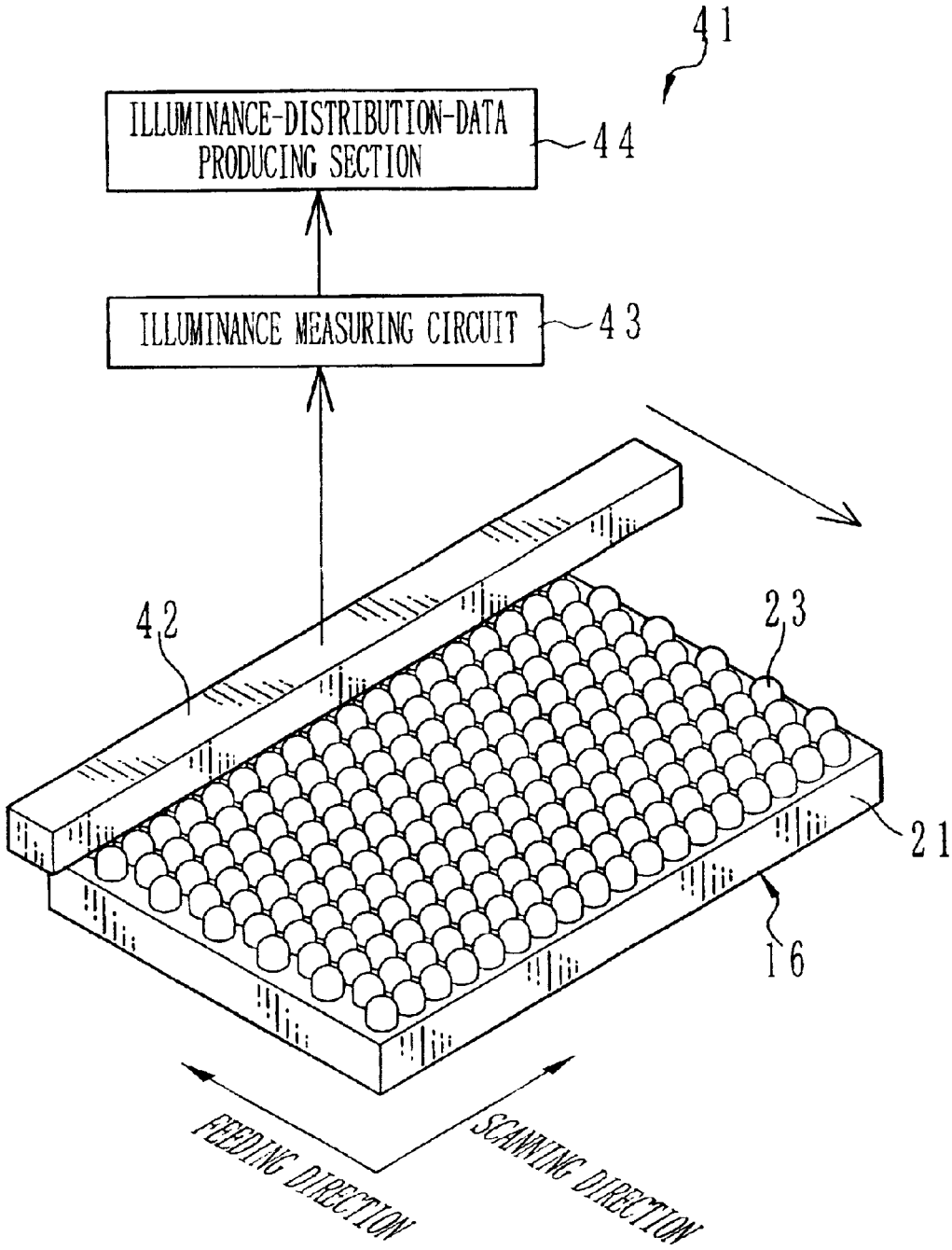
FIG. 6 is an explanatory illustration showing a measurement device for measuring the illuminance distribution in the scanning direction.

FIG. 6 shows a way for measuring the integral illuminance of the yellow luminous-element array 16. A measuring device 41 comprises a light-receiving-element array 42, an illuminance measuring circuit 43, and an illuminance-distribution-data producing section 44. In the light-receiving-element array 42, a large number of phototransistors are arranged, for instance. The light-receiving-element array 42 extends in the scanning direction of the yellow luminous-element array 16, and is attached so as to be movable in the feeding direction thereof. The array 42 receives the light emitted from the respective Y-LEDs 23, moving in the feeding direction. Further, the array 42 transmits an electric signal to the illuminance measuring circuit 43 in accordance with an amount of the received light.

The illuminance measuring circuit 43 converts the electric signal, which is received from the array 42, into a digital signal. The converted digital signal is transmitted to the illuminance-distribution-data producing section 44. This section 44 integrates the illuminance of the respective Y-LEDs 23 relative to each line extending in the feeding direction. Successively, the section 44 calculates the integral illuminance of each line. In this way, is obtained illuminance-distribution data in the scanning direction, such as shown in FIG. 3.

The foregoing description concerns the yellow luminous-element array. The magenta luminous-element array has a similar structure, and the integral illuminance thereof is similarly measured. In view of this, a description concerning the magenta luminous-element array is abbreviated.

Figure 7:
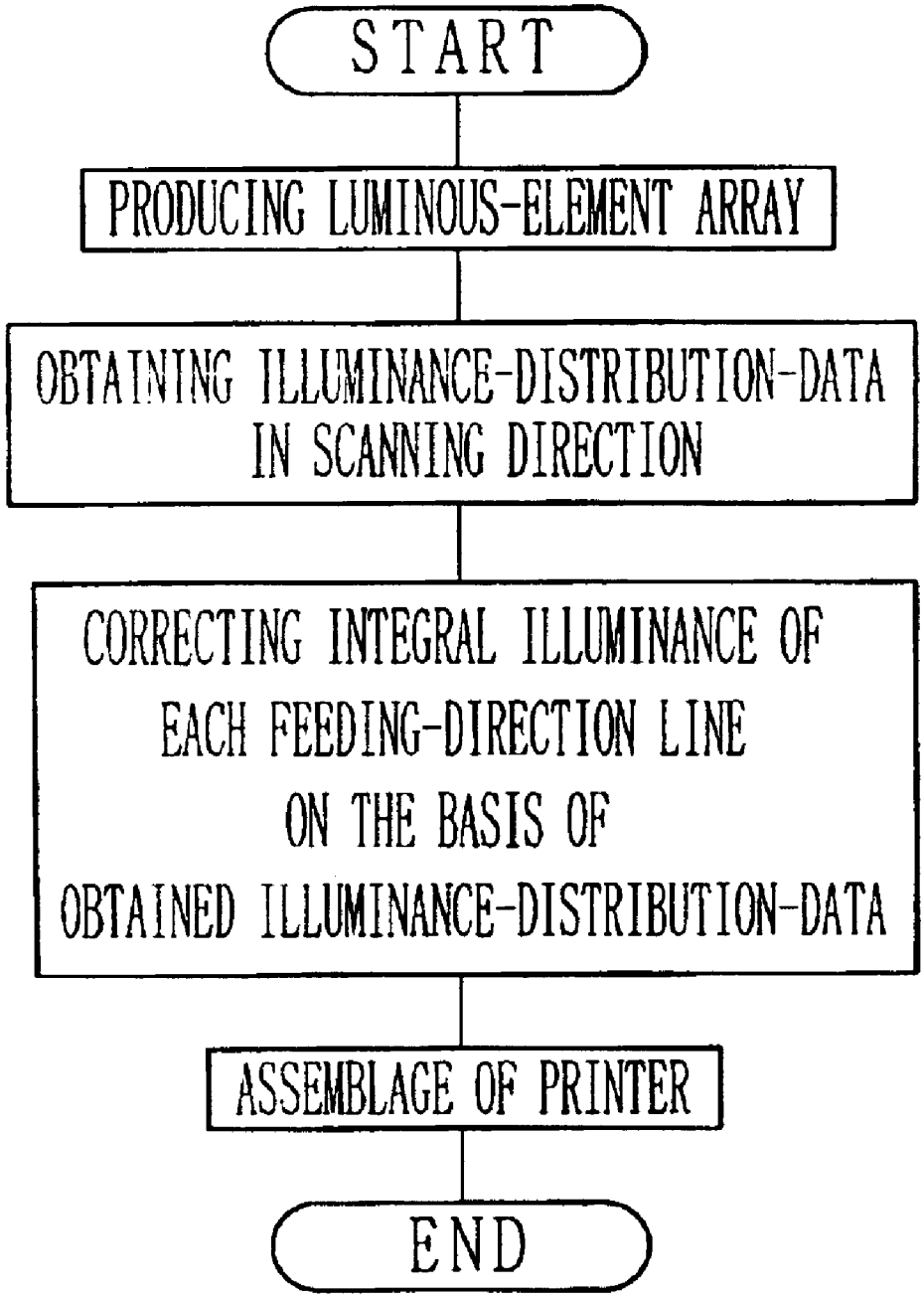
FIG. 7 is a flowchart showing a sequence for correcting the illuminance.

An operation of the above-described structure is explained below, referring to a flowchart shown in FIG. 7. After the luminous-element array has been manufactured, this array is forwarded to the examination process. In the examination process, the illuminance-distribution data in the scanning direction is measured with the measuring device 41.

Successively, the integral illuminance of the respective lines L1 to L6 are corrected so as to even up the illuminance distribution in the scanning direction. The measured value of the integral illuminance is assigned to any of the ranks shown in FIG. 5B to select the resistors in accordance with this rank. The selected resistors among the resistors R1 to R5 are connected by turning on and off the respective switches SW1 to SW5. Owing to this, the integral illuminance of each line is corrected and the illuminance distribution is evened in the scanning direction. After completing the illuminance correction, the luminous-element array is forwarded to an assembling process for a printer.

The illuminance correction is carried out by turning on and off the switches SW1 to SW5 in each line. Thus, the illuminance is easily corrected in comparison with the conventional method in which all the defective elements are searched to exchange and rewire them.

Figure 8:
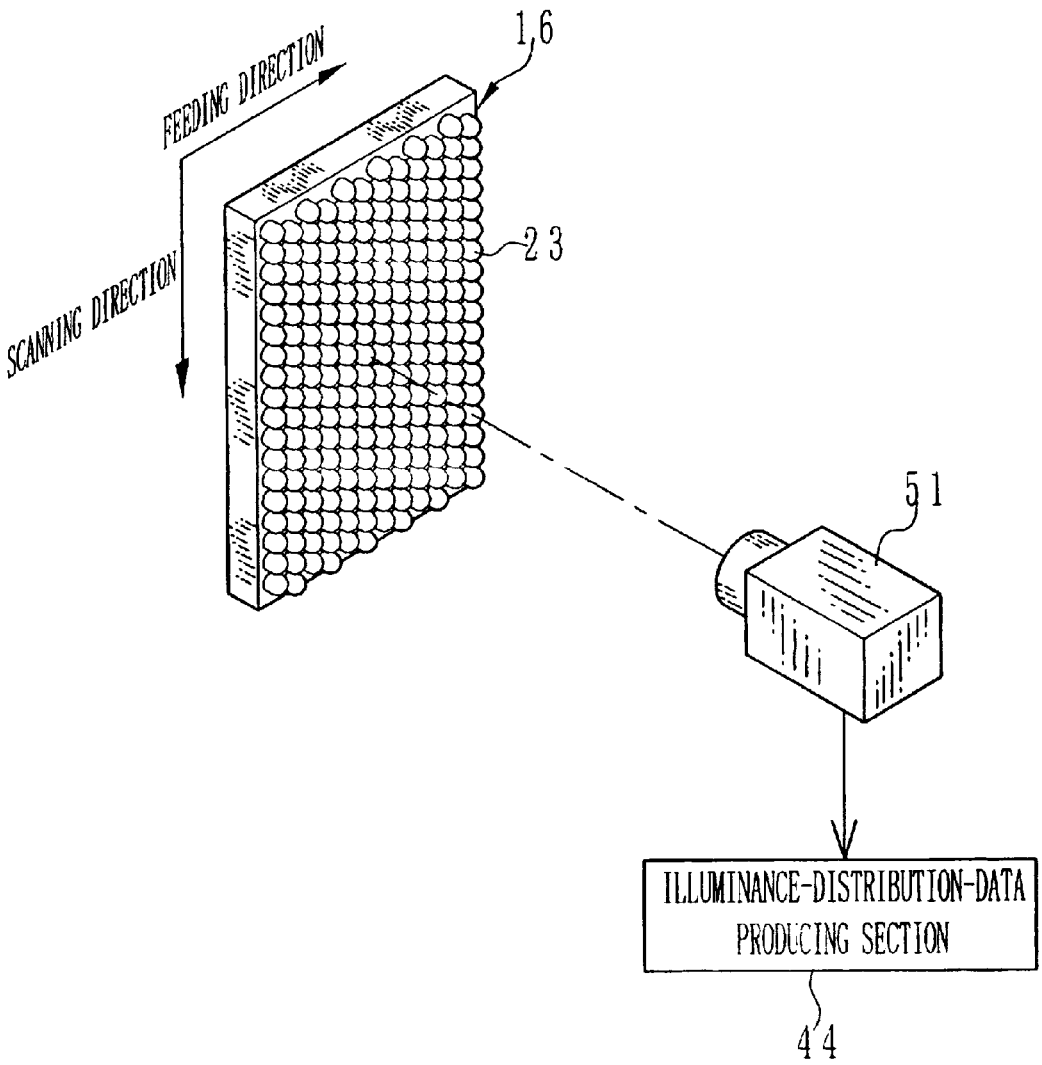
FIG. 8 is an explanatory illustration showing a way for measuring the illuminance distribution in the scanning direction with a CCD.

As to the measuring device for obtaining the illuminance-distribution data of the luminous-element array in the scanning direction, the above embodiment relates to the device employing the light-receiving-element array comprising many phototransistors. In another way, it is possible to employ an imaging device of a CCD camera 51, for instance, shown in FIG. 8. The CCD camera 51 transfers light-amount data of the yellow and magenta luminous-element arrays 16 and 17 to the illuminance-distribution-data producing section 44, which calculates the integral illuminance of each line on the basis of the data sent from the CCD camera 51.

With respect to the method for obtaining the illuminance-distribution data in the scanning direction, it is possible to adopt another method in which fixation unevenness is examined by actually applying the fixing light to a test paper (color thermosensitive recording paper) to perform a fixation test. In this case, the yellow luminous-element array is turned on first to apply the fixing light during a passage of the test paper. After that, a thermal head gives the test paper thermal energy for recording a solid image of yellow. At this time, the thermal head is corrected so as not to cause unevenness of heating performed thereby.

In virtue of this, the yellow colors on a portion lacking the fixation. On the basis of coloring-density distribution of the test paper, are calculated the integral illuminance of the respective lines in the feeding direction of the yellow luminous-element array so that the illuminance-distribution data in the scanning direction is obtained. With respect to the magenta luminous-element array, similar processes are executed. Incidentally, at the time of the fixation test, it is preferable to reduce the fixing-light amount, in comparison with the normal fixation, for the purpose of clearly reflecting the fixation unevenness in the coloring density.

As the adjustment member for adjusting the integral illuminance of the respective lines, the resistors connected in parallel are used. Besides this kind of the resistor, it is possible to use, for instance, a variable resistor and a film resistor whose resistance value is adjusted by laser trimming.

In the above embodiment, the integral illuminance of each line is corrected by adjusting the electric energy to be supplied to the respective line. However, the integral illuminance of each line may be corrected by repairing the defective element, for example, by rewiring it or exchanging the defective LED. In this case, it is unnecessary to repair all the defective elements. The repairing operation is performed for only the lines, which have lower integral illuminance in comparison with the others. Alternatively, a number of the luminous elements to be turned on may be reduced relative to the line having higher illuminance in comparison with the others. It is sufficient to carry out the correction such that the illuminance distribution is evened in the scanning direction. Thus, the correcting operation is lightened in comparison with the conventional operation.

As described above, the luminous-element array less depends on the temperature of the light amount in comparison with the mercury lamp. In the thermal printer of the above embodiment, the light amount of the luminous-element array is not controlled during the fixation. The light amount, however, is likely to change in accordance with the variations in temperature. In view of this, the light amount may be controlled during the fixation.

Figure 9:
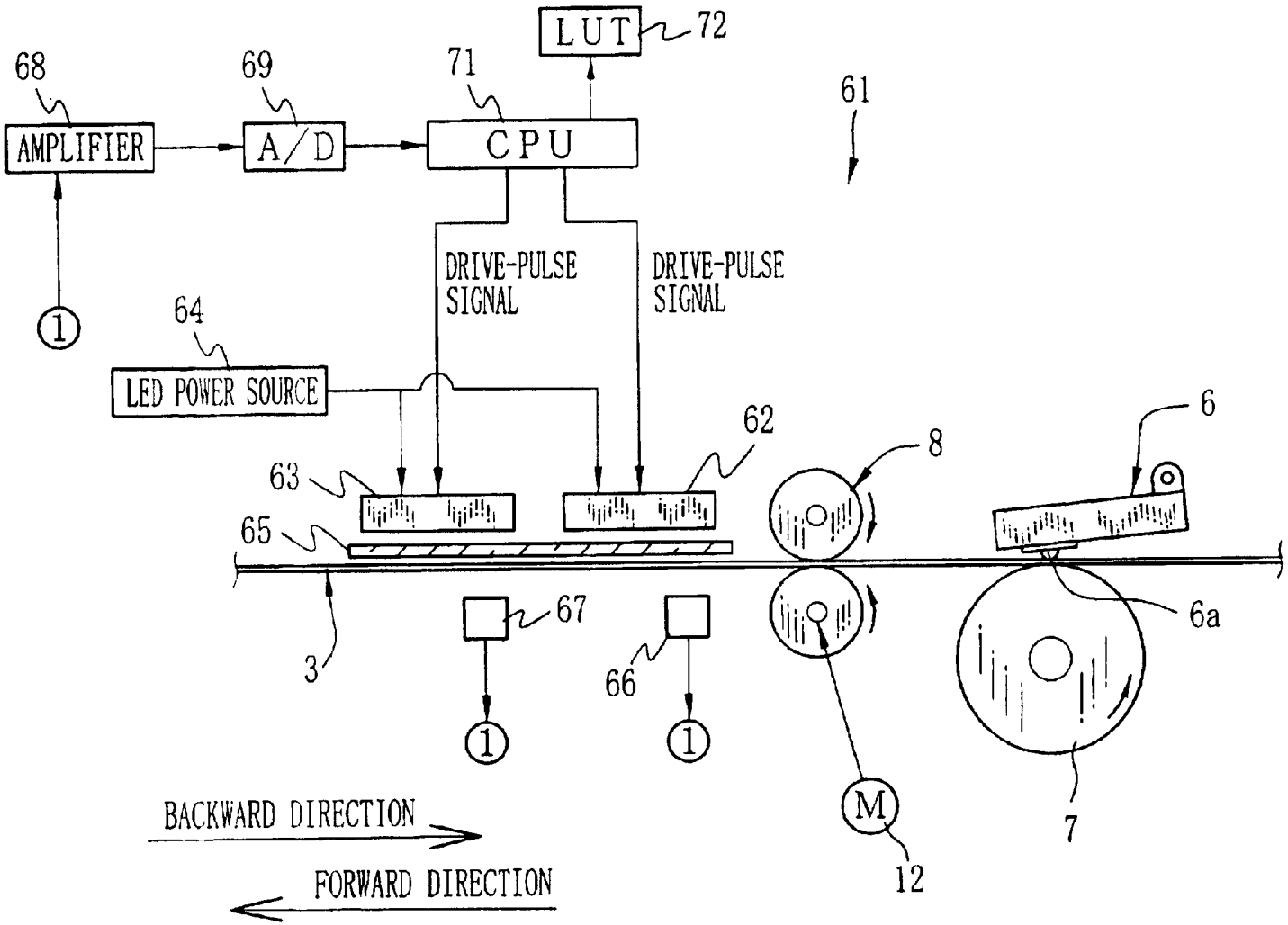
FIG. 9 is a schematic illustration showing a structure of a thermal printer in which an amount of rays is controlled during fixation.

FIG. 9 shows a thermal printer 61 in which a light amount is controlled by correcting the illuminance of the luminous-element array during fixation. Incidentally, a member which is identical with that of the above embodiment is denoted by the same reference numeral. Luminous-element arrays 62 and 63, which are used for yellow and magenta respectively, receive electric power from an LED power source 64. Illuminance sensors 66 and 67 are disposed at positions confronting light-emitting surfaces of the respective luminous-element arrays 62 and 63.

Each of the illuminance sensors 66 and 67 outputs an illuminance signal (sensor voltage) in accordance with the measured illuminance of each of the luminous-element arrays 62 and 63. The illuminance signal is amplified by an amplifier 68 and is outputted to an A–D converter 69. The amplifier 68 has a characteristic (LPF characteristic) for making only low-frequency component pass through. Thus, an output voltage of the amplifier 68 is relative to a mean value of the illuminance (measured illuminance) of the respective luminous-element arrays 62 and 63. Concretely, the luminous-element arrays 62 and 63 are driven by drive pulses so that these arrays are intermittently turned on. Since the amplifier 68 has the LPF characteristic, it is possible to measure the mean illuminance of the respective luminous-element arrays 62 and 63 within a fixed period, instead of measuring the maximum illuminance during one-time lighting of the respective luminous-element arrays 62 and 63. It is needless to say that the amplifier 68 need not possess the LPF characteristic. The mean illuminance of the respective luminous-element arrays 62 and 63 may be measured by a CPU 71 on the basis of the output of the amplifier 68.

The A–D converter 69 converts the inputted illuminance signal of analog into digital data which is outputted to the CPU 71. This CPU 71 compares the inputted illuminance data (measured illuminance) with a desired value, which is stored in a LUT 72 in advance, to correct the illuminance of the respective luminous-element arrays 62 and 63. Incidentally, the luminous-element arrays 62 and 63 are driven by a drive-pulse signal outputted from the CPU 71.

By the way, reference numeral 65 denotes a diffusion plate for diffusing the rays, which are emitted from the respective luminous-element arrays 62 and 63 toward the color thermosensitive recording paper 3. In the case that the plural luminous elements are arranged, it is necessary to arrange the luminous elements at certain intervals for the purpose of preventing deterioration to be caused by self heating of the respective luminous elements. Due to this, although the respective lines are adjusted so as to even out the illuminance distribution in the scanning direction, it is impossible to perfectly even out the illuminance distribution. In this embodiment, by providing the diffusion plate 65, the light from the luminous-element array is diffused to reduce the unevenness of the illuminance distribution. The diffusion plate 65 is formed from a transparent plastic material, for instance. When a transparent conveyor guide-plate for guiding a course of the recording paper is provided in a conveyor passage, the guide-plate may be used as the diffusion plate instead of providing the guide-plate and the diffusion plate separately.

Figure 10A:
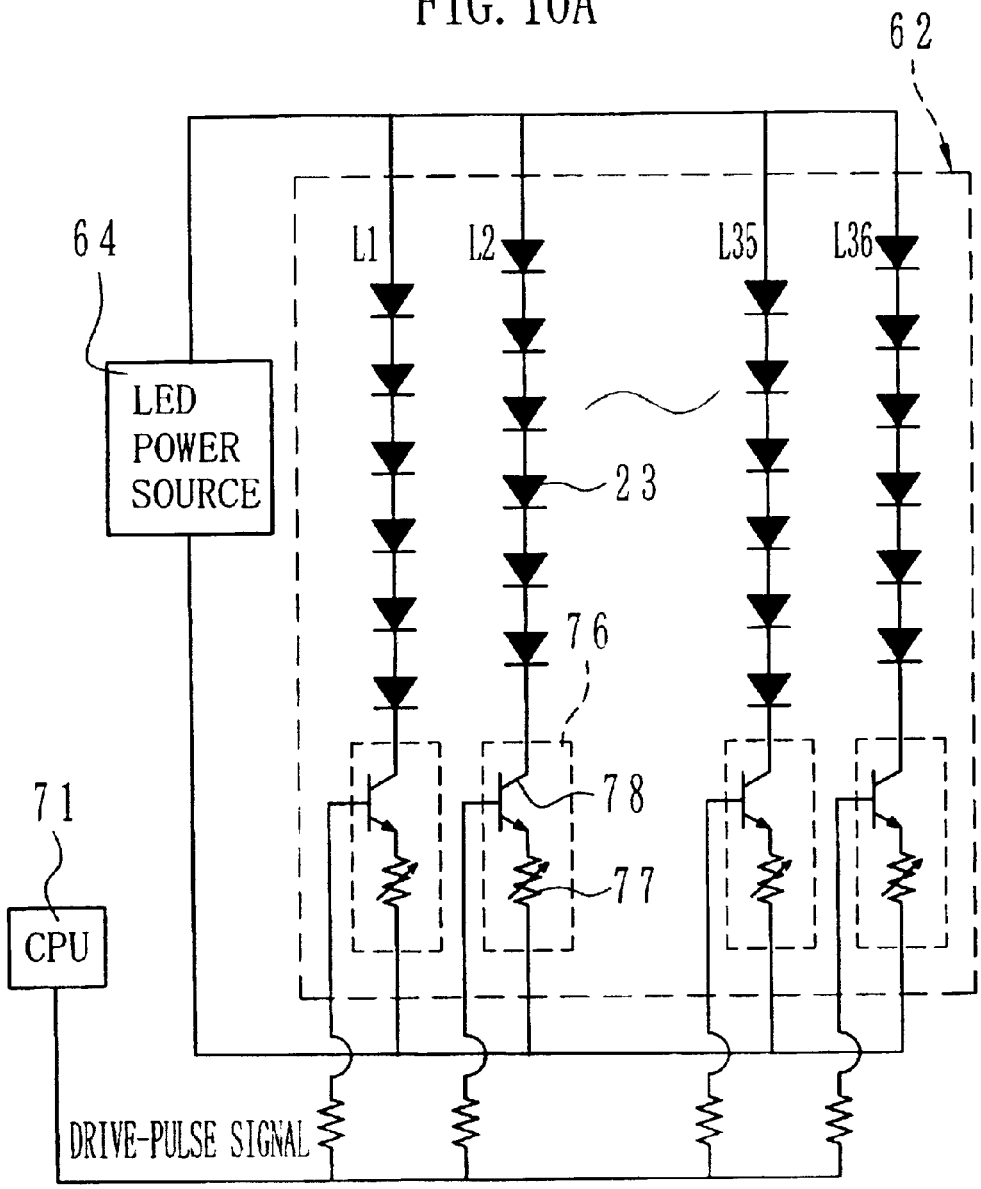
FIGS. 10A and 10B are explanatory illustrations of a luminous-element array used in the thermal printer shown in FIG. 9.
Figure 10B:
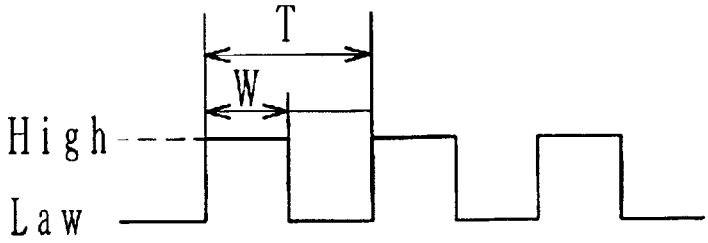

As shown in FIG. 10, the yellow luminous-element array 62 is provided with current stabilizing circuits 76 for the respective lines L1 to L36 extending in the feeding direction. The current stabilizing circuit 76 is connected to the yellow LEDs 23 in series. The current stabilizing circuit 76 is a current generator for passing the constant current without being affected by the other circuit elements. The current stabilizing circuit 76 comprises a variable resistor 77 and a transistor 78. The variable resistor 77 is for adjusting a value of the current flowing in each line. The yellow luminous-element array 62 is regulated so as to even out the illuminance distribution in the scanning direction by adjusting resistance values of the respective variable resistors 77.

The transistor 78 is a switching member, which controls the current flowing in each of the lines L1 to L36 to turn on and off the yellow LEDs 23 thereof. The drive-pulse signal from the CPU 71 is inputted into a base of the transistor 78. When a signal level of the drive pulse is high, the transistor 78 is turned on so that the yellow LED 23 of each line emits the light. When the signal level of the drive pulse is low, the yellow LED 23 is turned off. The CPU 71 corrects the illuminance of the yellow luminous-element array 62 during the fixation by changing a duty ratio of the drive-pulse signal in accordance with the illuminance signal. By the way, the duty ratio is a ratio of W to T shown in FIG. 10B, wherein T represents a cycle of a pulse train and W represents the duration of the pulse.

Although the transistor 78 is provided for each line, the drive-pulse signals to be inputted into the respective transistors 78 are the same relative to all the line L1 to L36. By providing the transistor 78 for each line, it is possible to change the line to be turned on in accordance with a width of the color thermosensitive recording paper 3. Incidentally, the yellow luminous-element array 62 is described as an example. The magenta luminous-element array 63 has a similar structure so that description thereof is abbreviated.

Figure 11:
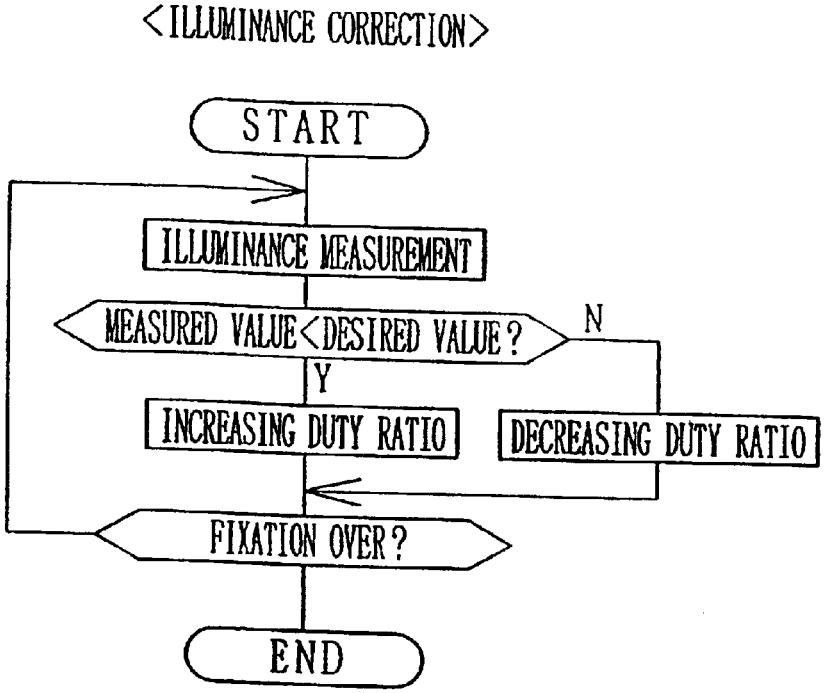
FIG. 11 is a flowchart showing a sequence for controlling an amount of the rays on the basis of illuminance correction.

FIG. 11 shows a flowchart of the illuminance correction to be executed during the fixation. When fixing the yellow and the magenta, the yellow luminous-element array 62 and the magenta luminous-element array 63 are respectively turned on. The illuminance sensors 66 and 67 output the illuminance signal (measured illuminance) to the amplifier 68. The CPU 71 compares the measured illuminance with the desired value to change the duty ratio of the drive-pulse signal. In other words, when the measured illuminance is lower than the desired value, the duty ratio is increased to raise the illuminance. In contrast, when the measured illuminance is higher than the desired value, the duty ratio is reduced to lower the illuminance. This correction is carried out at fixed intervals until the fixation is completed.

Figure 12:
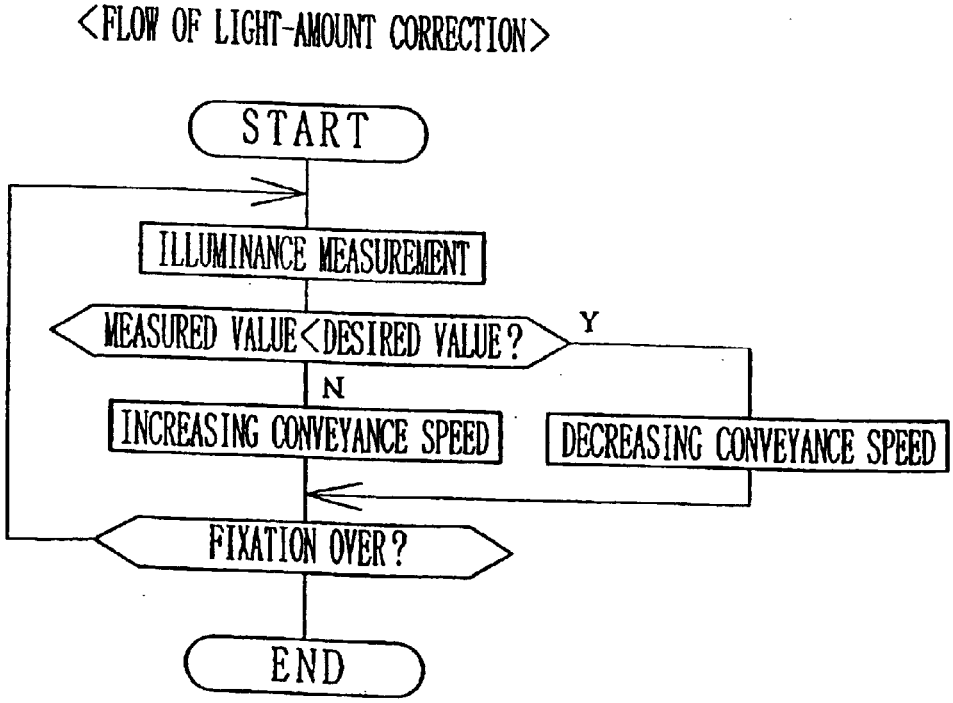
FIG. 12 is a flowchart showing a sequence for controlling the amount of the rays on the basis of adjustment of conveyance speed.

Instead of correcting the illuminance of the luminous-element array, a light amount to be received by the color thermosensitive recording paper 3 may be corrected by adjusting a conveyance speed for conveying the recording paper 3, such as shown by a flowchart in FIG. 12. In this case, the illuminance is measured by the illuminance sensor, and the measured illuminance is compared with the desired value. When the measured illuminance is lower than the desired value, the conveyance speed is slowed (retardation) to increase the light amount to be received. In contrast, when the measured illuminance is higher than the desired value, the conveyance speed is raised (acceleration) to reduce the light amount to be received.

Figure 13:
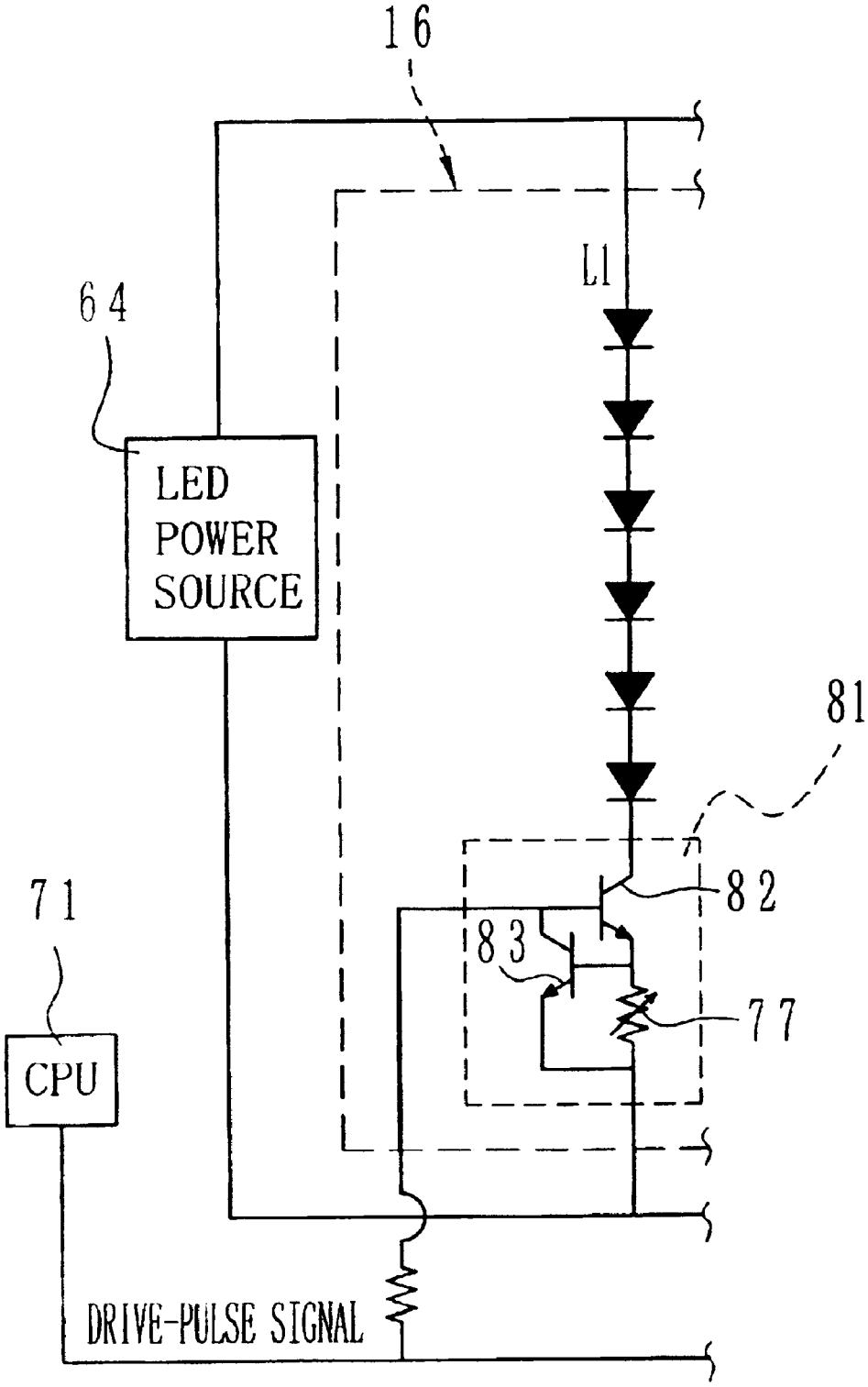
FIG. 13 is an explanatory illustration showing an example of the current stabilizing circuit in a case that temperature of a substrate is measured.

Meanwhile, as to the luminous element, the allowable maximum current thereof changes in accordance with the temperature. This maximum current is smaller as the temperature is higher. If the current exceeding the maximum current flows in the luminous element, the life thereof is shortened. Thus, the current flowing in the luminous element is preferable to be prevented, in accordance with the temperature of the luminous element, from exceeding the maximum current value. A current stabilizing circuit 81 shown in FIG. 13 can measure the temperature of the base so that the temperature of the luminous element may be estimated from the temperature of the base. By using the current stabilizing circuit 81, the current flowing therein may be controlled in accordance with the temperature of the luminous element so as to be the allowable maximum current value or less. Thus, the luminous-element array is prevented from deteriorating.

The current stabilizing circuit 81 comprises the variable resistor 77 and two transistors 82 and 83. A voltage of a terminal to which a drive-pulse signal is inputted from the CPU 71 is the sum of base-emitter voltages Vbe of the respective transistors 82 and 83. The CPU 71 measures the voltage of the terminal to measure the temperature of the base. At the same time, the CPU 71 estimates the temperature of the luminous element from the measured temperature of the base.

The CPU 71 adjusts the duty ratio of the drive pulse in accordance with the estimated temperature of the luminous element such that the current flowing in the luminous element is adjusted so as to be the maximum current value or less. In this case, the duty ratio must be lowered as the temperature becomes higher. Consequently, the illuminance of the luminous-element array declines. A decrease of the illuminance is compensated by adjusting a speed for conveying the color thermosensitive recording paper. A desired amount of the fixing light is secured by adjusting the conveying speed so that imperfect fixation is not caused.

Although the present invention has been fully described by way of the preferred embodiments thereof with reference to the accompanying drawings, various changes and modifications will be apparent to those having skill in this field. Therefore, unless otherwise these changes and modifications depart from the scope of the present invention, they should be construed as included therein.

What is claimed is:

1. An illuminance correcting method for an optical fixing unit including a luminous-element array being as a light source in which luminous elements for radiating ultraviolet rays are arranged in matrix so as to align in a scanning direction and a feeding direction, said optical fixing unit performing optical fixation by the ultraviolet rays of said light source during conveyance of a thermosensitive recording material for which thermal recording is already carried out, and said optical fixing unit being used in a thermal printer thermally recording an image by heating the thermosensitive recording material conveyed in the feeding direction with a thermal head disposed in the scanning direction, said illuminance correcting method comprising the steps of:

obtaining integral illuminance of the luminous elements belonging to each line extending in the feeding direction of said luminous-element array;

checking illuminance distribution in the scanning direction on the basis of the obtained integral illuminance; and correcting the integral illuminance with respect to the respective lines so as to even out the illuminance distribution in the scanning direction.

2. An illuminance correcting method according to claim 1, wherein said luminous elements are connected in series with respect to each line extending in the feeding direction, and the integral illuminance is corrected by adjusting electric energy to be supplied to the luminous elements of the respective lines.

3. An illuminance correcting method according to claim 2, wherein said integral illuminance is corrected by adjusting an electric current flowing in the luminous elements of each line.

4. An illuminance correcting method according to claim 3, wherein said integral illuminance is corrected at the time of manufacturing the luminous-element array.

5. An illuminance correcting method according to claim 3, wherein said integral illuminance is corrected during fixation of said thermosensitive recording material.

6. An illuminance correcting method according to claim 1, wherein said integral illuminance is obtained by illuminance measuring means comprising:

light-receiving-element array having a plurality of light receiving elements for receiving the rays emitted from the luminous elements, said light-receiving-element array extending in the scanning direction and being movable in the feeding direction;

an illuminance measuring circuit receiving an electric signal outputted from the light-receiving-element array, said illuminance measuring circuit converting the electric signal into a digital signal; and an illuminance-distribution-data producing section receiving the digital signal and calculating the integral illuminance of the respective lines of the luminous elements.

7. An illuminance correcting method according to claim 6, wherein said light receiving element is a phototransistor.

8. An illuminance correcting method according to claim 1, wherein said integral illuminance is obtained by illuminance measuring means comprising:

a CCD camera for taking light-amount data of the luminous-element array; and an illuminance-distribution-data producing section receiving the light-amount data from the CCD camera and calculating the integral illuminance of the respective lines of the luminous elements.

9. The illuminance correcting method of claim 1, wherein the luminous elements belonging to each line in the feeding direction are connected in series to constitute a luminous-element line.

10. The illuminance correcting method of claim 9, wherein the luminous-element line, which extends in the feeding direction, comprises luminous elements from alternating rows of luminous elements that extend in the scanning direction.

11. The illuminance correcting method of claim 9, wherein respective edges that structurally define each luminous element in the scanning direction are in alignment in the luminous-element line.

12. The illuminance correcting method of claim 1, wherein the integral illuminance is a summation of luminance from a plurality of luminous elements.

13. An optical fixing unit for performing optical fixation by ultraviolet rays while a thermosensitive recording material, for which thermal recording is already carried out, is conveyed in a feeding direction, said optical fixing unit comprising:

a luminous-element array having a plurality of luminous elements radiating the ultraviolet rays and arranged in matrix so as to align in the feeding direction and a scanning direction perpendicular to the feeding direction, said luminous elements aligned in the feeding direction being connected in series to constitute a luminous-element line; and adjustment means for changing electric energy to be supplied to the respective luminous-element lines, said adjustment means adjusting integral illuminance of the respective luminous-element lines.

14. An optical fixing unit according to claim 13, wherein said adjustment means adjusts the integral illuminance by changing an electric current flowing in the luminous-element line.

15. An optical fixing unit according to claim 14, wherein said adjustment means is a current stabilizing circuit having a plurality of resistors which are connectable in parallel.

16. An optical fixing unit according to claim 15, wherein said current stabilizing circuit includes switches respectively connected to said resistors, said switches being selectively turned on and off to change the electric current.

17. An optical fixing unit according to claim 16, wherein said luminous element is a light emitting diode.

18. The optical fixing unit of claim 13, wherein the luminous-element line, which extends in the feeding direction, comprises luminous elements from alternating rows of luminous elements that extend in the scanning direction.

19. The optical fixing unit of claim 13, wherein respective edges that structurally define each luminous element in the scanning direction are in alignment in the luminous-element line.

20. The optical fixing unit of claim 13, wherein the integral illuminance is a summation of luminance from a plurality of luminous elements.

21. A thermal printer including conveyance means, a thermal head and an optical fixing unit, said conveyance means conveying a thermosensitive recording material in a feeding direction, said thermal head being disposed in a scanning direction to thermally record an image by heating the thermosensitive recording material, and said optical fixing unit having a luminous-element array, in which luminous elements for radiating ultraviolet rays are arranged in matrix so as to align in the scanning direction and the feeding direction, to perform optical fixation by radiating the ultraviolet rays from the luminous-element array relative to the thermally-recorded thermosensitive recording material during conveyance thereof, said thermal printer comprising:

adjustment means for changing electrical energy to be supplied to a luminous-element line in which the luminous elements are connected in series in the feeding direction, said adjustment means adjusting integral illuminance of the respective luminous-element lines.

22. A thermal printer according to claim 21, further comprising:

illuminance measuring means for measuring illuminance of the luminous-element array; and light-amount control means for comparing a measured value obtained by the illuminance measuring means with a preset desired value to control a light amount to be received by the thermosensitive recording material.

23. A thermal printer according to claim 22, wherein said illuminance measuring means comprising:

an illuminance sensor for outputting an illuminance signal in accordance with the measured illuminance of said luminous-element array;

an amplifier for amplifying the illuminance signal outputted from said illuminance sensor; and an A–D converter for converting the illuminance signal amplified by said amplifier, into digital data.

24. A thermal printer according to claim 23, wherein said luminous-element array is driven by a drive pulse signal, and said light-amount control means corrects the illuminance of said luminous-element array by changing a duty ratio of said drive pulse signal.

25. A thermal printer according to claim 24, wherein said adjustment means adjusts the integral illuminance by changing an electric current flowing in the respective luminous-element lines.

26. A thermal printer according to claim 25, wherein said adjustment means includes a variable resistor and a transistor, said variable resistor adjusting the electric current flowing in the respective luminous-element lines, and said transistor being turned on and off in accordance with said drive pulse signal.

27. The thermal printer of claim 21, wherein the luminous-element line, which extends in the feeding direction, comprises luminous elements from alternating rows of luminous elements that extend in the scanning direction.

28. The thermal printer of claim 21, wherein respective edges that structurally define each luminous element in the scanning direction are in alignment in the luminous-element line.

29. The thermal printer of claim 21, wherein the integral illuminance is a summation of luminance from a plurality of luminous elements.

* * * * *